US009708790B2

(12) United States Patent
Connolly

(10) Patent No.: US 9,708,790 B2
(45) Date of Patent: Jul. 18, 2017

(54) SYSTEM AND METHOD FOR FOUNDATION SLAB LIQUID COLLECTION AND MANAGEMENT

(71) Applicant: Oldcastle Precast, Inc., Auburn, WA (US)

(72) Inventor: John P. Connolly, Auburn, KS (US)

(73) Assignee: OLDCASTLE PRECAST, INC., Auburn, WA (US)

( * ) Notice: Subject to any disclaimer, the term of this patent is extended or adjusted under 35 U.S.C. 154(b) by 123 days.

(21) Appl. No.: 14/625,432

(22) Filed: Feb. 18, 2015

(65) Prior Publication Data

US 2015/0233083 A1 Aug. 20, 2015

Related U.S. Application Data

(60) Provisional application No. 61/941,031, filed on Feb. 18, 2014.

(51) Int. Cl.

| | |
|---|---|
| ***E02D 19/00*** | (2006.01) |
| ***E02D 31/02*** | (2006.01) |
| ***E03F 5/04*** | (2006.01) |
| ***E03F 1/00*** | (2006.01) |

(52) U.S. Cl.

CPC ..... *E02D 31/02* (2013.01); *E02D 19/00* (2013.01); *E03F 1/00* (2013.01); *E03F 5/04* (2013.01)

(58) Field of Classification Search

CPC ..... E02D 19/00; E02D 31/02; E02D 31/04; E02D 31/06; E03F 1/00; E03F 3/046; E03F 5/04

USPC ..... 210/163, 164, 170.03, 747.2, 727.3; 52/169.5, 302.1, 302.3, 741.4, 745.1; 404/2, 4; 405/36, 118, 119, 120

See application file for complete search history.

(56) References Cited

U.S. PATENT DOCUMENTS

| | | | | |
|---|---|---|---|---|
| 3,990,469 | A * | 11/1976 | Ralston | E02D 31/02 52/288.1 |
| 4,498,807 | A * | 2/1985 | Kirkpatrick | E03F 3/046 210/163 |
| 4,515,498 | A * | 5/1985 | Thomann | E01C 11/227 210/164 |
| 5,256,000 | A * | 10/1993 | Beamer | E03F 3/046 405/119 |
| 5,647,689 | A * | 7/1997 | Gunter | E03F 3/046 405/36 |
| 5,848,856 | A * | 12/1998 | Bohnhoff | E03F 5/101 405/36 |
| 6,230,468 | B1 * | 5/2001 | Klaus | E02D 31/06 52/169.5 |
| 6,612,780 | B2 * | 9/2003 | Dahowski | E03F 3/046 210/164 |

(Continued)

FOREIGN PATENT DOCUMENTS

| | | | |
|---|---|---|---|
| EP | 2725146 | * | 4/2014 |

*Primary Examiner* — Christopher Upton

(74) *Attorney, Agent, or Firm* — Sheridan Ross PC

(57) ABSTRACT

A foundation slab liquid collection and management system is provided. The system includes a system and apparatus including a plurality of drain channels, a plurality of liquid collection plates, a foundation slab, a plurality of channel connecting anchors, a plurality of slab connecting anchors, and at least one liquid collection and storage container, for collecting, storing, treating, or otherwise managing liquid runoff from the slab.

20 Claims, 7 Drawing Sheets

(56) References Cited

U.S. PATENT DOCUMENTS

| | | | | |
|---|---|---|---|---|
| 8,157,991 | B2 * | 4/2012 | Wilhelms | E03F 1/002<br>210/170.03 |
| 2009/0223147 | A1 * | 9/2009 | Spignesi | E04D 13/0431<br>52/169.5 |
| 2013/0036691 | A1 * | 2/2013 | Janesky | E02D 31/02<br>52/302.1 |

* cited by examiner

SYSTEM AND METHOD FOR FOUNDATION SLAB LIQUID COLLECTION AND MANAGEMENT

CROSS-REFERENCE TO RELATED APPLICATION

This U.S. Non-Provisional Patent Application claims the benefit of priority from U.S. Provisional Patent Application Ser. No. 61/941,031, filed Feb. 18, 2014, the entire disclosure of which is hereby incorporated by reference in its entirety.

FIELD OF THE INVENTION

This invention relates generally to the field of foundation slabs. More specifically, embodiments of the present invention are directed to unique systems for foundation slab liquid collection and management, and methods of use thereof.

BACKGROUND

Concrete foundation slabs are susceptible to failure since they fail to provide adequate means of protecting the foundation from water damage. Over time, water can seep into the concrete, and eventually cause the concrete and foundation to become damaged or fail. In the winter, the water can freeze, causing the concrete to swell and fracture, potentially affecting the structural integrity of any structure built upon the foundation. A system is needed that can adequately collect and move water away from foundation, such that the foundation remains structurally intact.

SUMMARY

The Summary of the Invention is neither intended nor should it be construed as being representative of the full extent and scope of the present disclosure. The present disclosure is set forth in various levels of detail in the Summary of the Invention as well as in the attached drawings and the Detailed Description of the Invention and no limitation as to the scope of the present disclosure is intended by either the inclusion or non-inclusion of elements, components, etc. in this Summary of the Invention. Additional aspects of the present disclosure will become more readily apparent from the Detailed Description, particularly when taken together with the drawings.

In view of the limitations now present in the prior art systems and methods for foundation slab drainage management, the present invention provides a new and novel foundation slab liquid collection and management system and method of use thereof which is simpler in fabrication, more universally functional and more versatile in application and operation than known prior art methods or devices.

In various embodiments, the present invention provides a new foundation slab liquid collection and management system and method of use thereof that may be used to collect and manage liquids that fall, spill, or leak onto the slab. It is also a purpose of the present invention to provide a new foundation slab liquid collection and management system and method of use thereof that has many novel features not offered by the prior art, that result in a new and novel foundation slab liquid collection and management system which is not apparent, obvious, or suggested, either directly or indirectly by any of the prior art devices, apparatus, or methods.

In one embodiment of the present invention, a liquid collection segment is provided comprising an open rectilinear cross-section and an internal trough for directing liquid to a point of lower gravitational potential energy. The liquid collection segment comprises at least one planar surface adapted to be positioned adjacent a substantially vertical sidewall of a foundation slab. The liquid collection segment may optionally comprise a single drain outlet and a slope for directing a liquid to the drain outlet. The liquid collection segment may comprise a means for interconnecting the liquid collection segment to another liquid collection segment. An upper portion of the liquid collection segment additionally may comprise a grate to allow for ingress of liquid.

In one embodiment of the present invention, a liquid drainage and collection system for a foundation slab is provided, the system comprising a plurality of liquid collection segments, each of the plurality of liquid collection segments comprising an open rectilinear cross-section and an internal trough for directing liquid to a point of lower gravitational potential energy. The plurality of liquid collection segments comprise at least one planar surface adapted to be positioned adjacent a substantially vertical sidewall of a foundation slab. The plurality of liquid collection segments further comprise a single drain outlet and a slope for directing a liquid to the drain outlet, and the system is devoid of any other drain outlet and the drain outlet is provided in fluid communication with a conduit for conveying liquid to at least one of a storage container and a treatment container. Treatment containers of the present invention comprise any one or more of oil/water separators, grease traps, desalinators, flocculators, and similar devices as will be recognized by one of skill in the art.

In another embodiment, a liquid drainage and collection system for a foundation slab is provided, the system comprising a plurality of liquid collection segments, each of said plurality of liquid collection segments comprising opposed and substantially parallel side panels, a bottom panel provided substantially perpendicular to said side panels, and an at least partially open upper section to allow for an ingress of liquid into an interior volume of the segment(s). The interior volume of the collection segments preferably comprises a longitudinally extending channel for receiving and conveying liquid, and at least one of the side panels comprises an anchor member for interconnecting a liquid collection segment to a foundation slab. The plurality of liquid collection segments comprises at least one drain outlet and at least one slope for directing a liquid to the drain outlet.

In one embodiment, a method of forming a liquid drainage and collection system for a slab foundation is provided, the method comprising the steps of: providing a slab foundation with a predetermined thickness and at least one substantially vertical sidewall; providing a plurality of liquid collection segments, each of the plurality of liquid collection segments comprising a substantially vertical surface; positioning the plurality of liquid collection segments such that the substantially vertical surfaces are provided adjacent to the at least one substantially vertical sidewall of said slab foundation, and wherein the plurality of liquid collection segments are in fluid communication with each other, wherein at least one of said liquid collection segments comprises an outlet; providing each of the plurality of liquid collection segments with a desired slope for conveying liquid to at least one adjacent liquid collection segment under the force of gravity; and providing a conduit and a liquid storage and/or treatment container wherein the outlet, the conduit and the liquid storage and/or treatment container are in fluid communication with each other.

These and other advantages will be apparent from the disclosure of the invention(s) contained herein. The above-described embodiments, objectives, and configurations are neither complete nor exhaustive. As will be appreciated, other embodiments of the invention are possible using, alone or in combination, one or more of the features set forth above or described in detail below. Further, the summary of the invention is neither intended nor should it be construed as being representative of the full extent and scope of the present invention. The present invention is set forth in various levels of detail in the summary of the invention, as well as, in the attached drawings and the detailed description of the invention and no limitation as to the scope of the present invention is intended to either the inclusion or non-inclusion of elements, components, etc. in this summary of the invention. Additional aspects of the present invention will become more readily apparent from the detailed description, particularly when taken together with the drawings.

BRIEF DESCRIPTION OF THE DRAWINGS

Those of skill in the art will recognize that the following description is merely illustrative of the principles of the disclosure, which may be applied in various ways to provide many different alternative embodiments. This description is made for illustrating the general principles of the teachings of this disclosure invention and is not meant to limit the inventive concepts disclosed herein.

The accompanying drawings, which are incorporated in and constitute a part of the specification, illustrate embodiments of the disclosure and together with the general description of the disclosure given above and the detailed description of the drawings given below, serve to explain the principles of the disclosures.

It should be understood that the drawings are not necessarily to scale. In certain instances, details that are not necessary for an understanding of the disclosure or that render other details difficult to perceive may have been omitted. It should be understood, of course, that the disclosure is not necessarily limited to the particular embodiments illustrated herein.

Figure 1:
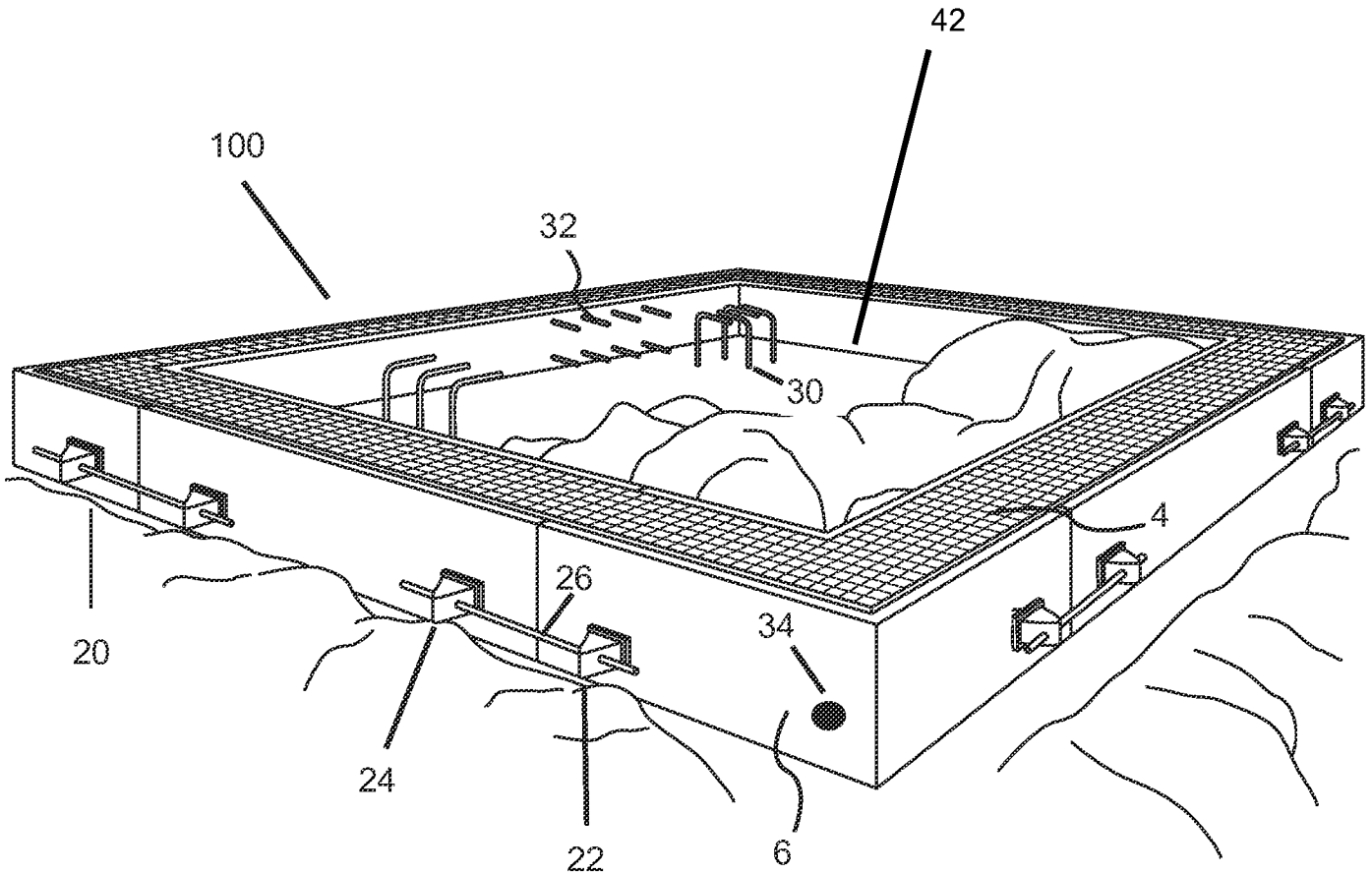
Figure 2:
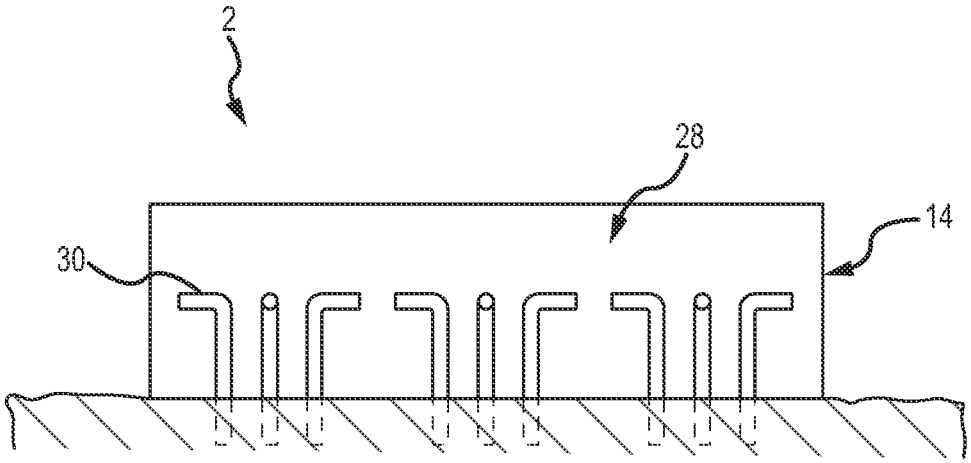
Figure 3A:
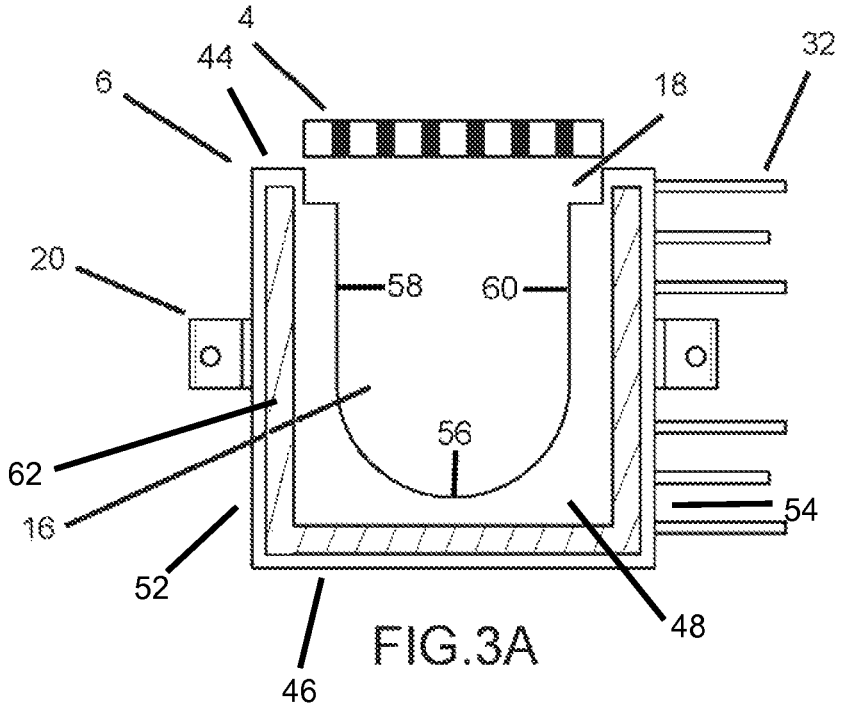
Figure 3B:
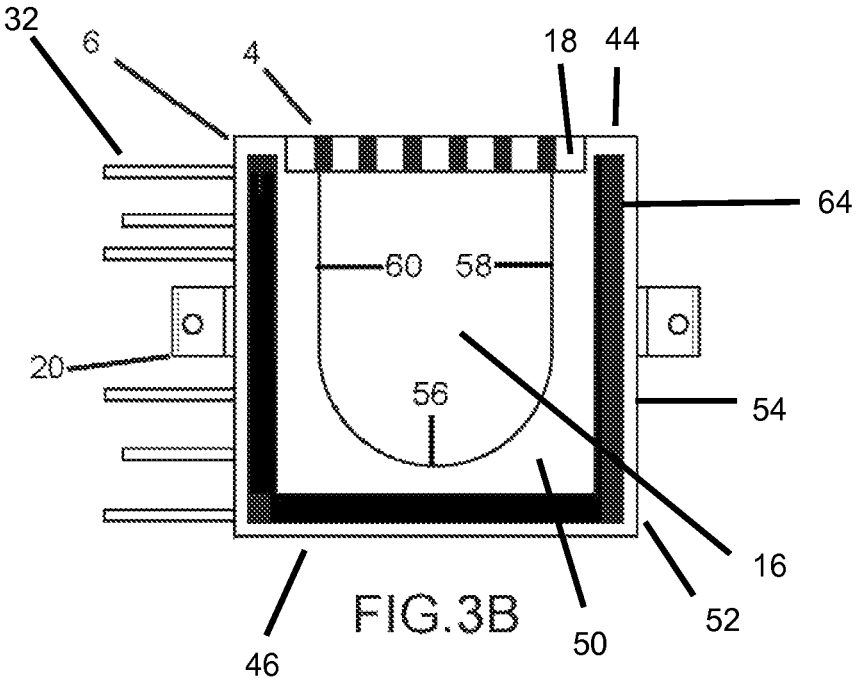
Figure 4A:
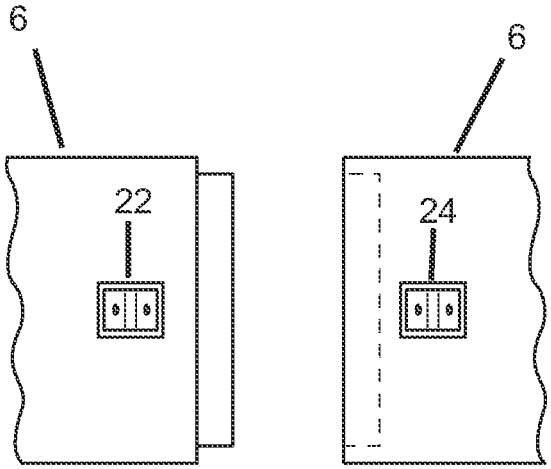
Figure 4B:
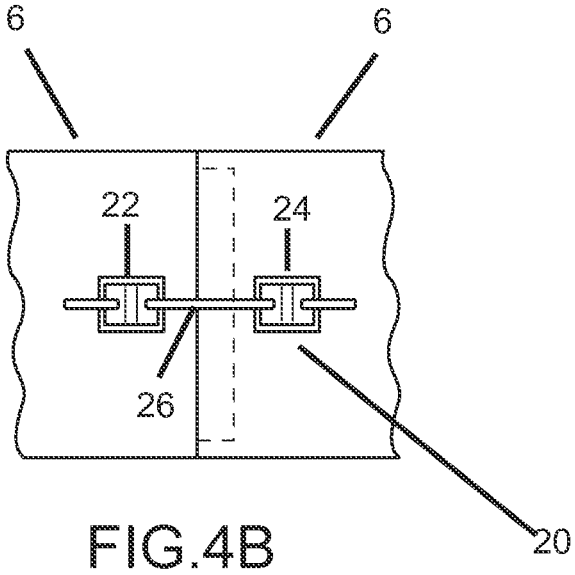
Figure 5:
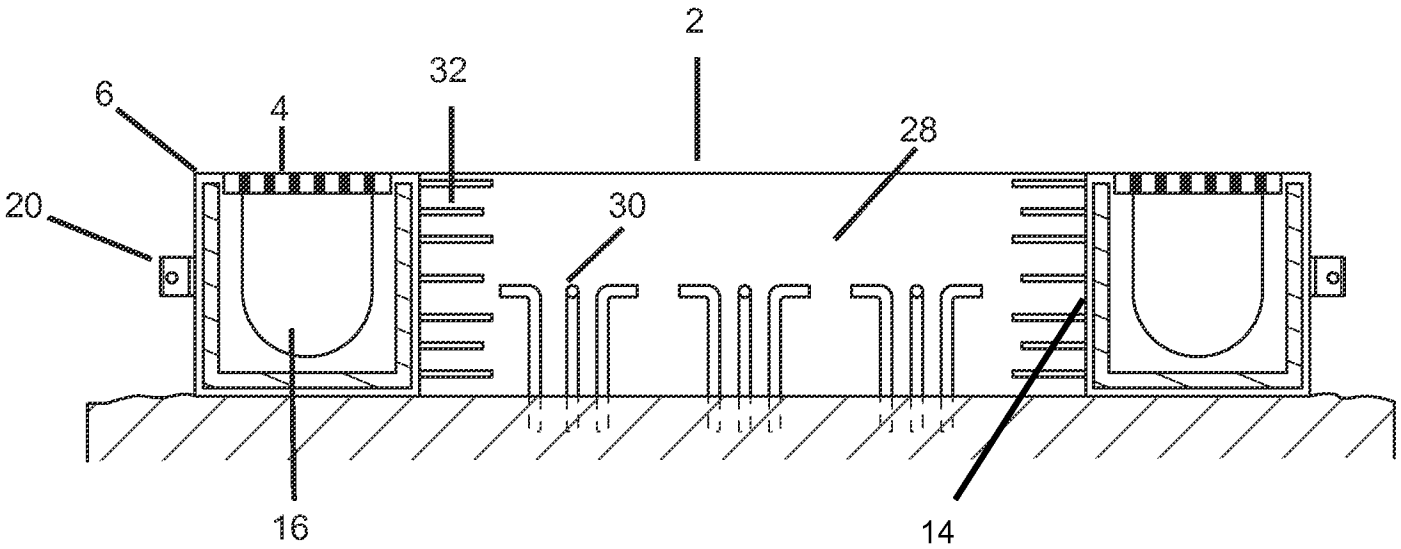
Figure 6B:
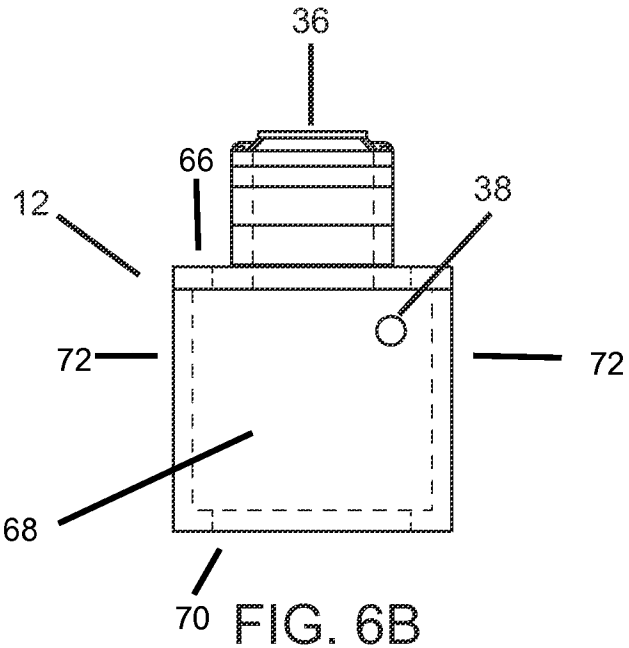
Figure 6A:
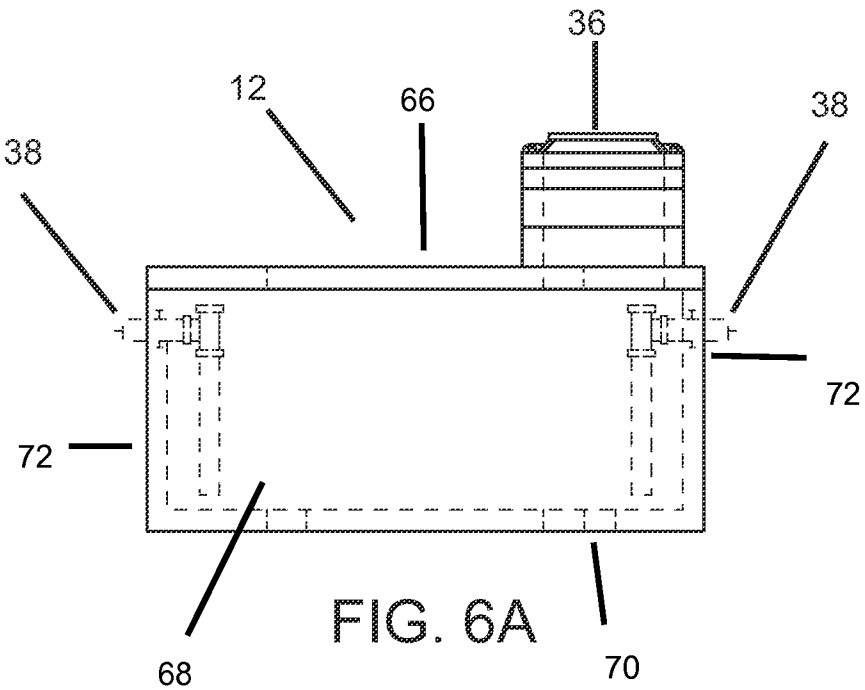
Figure 7:
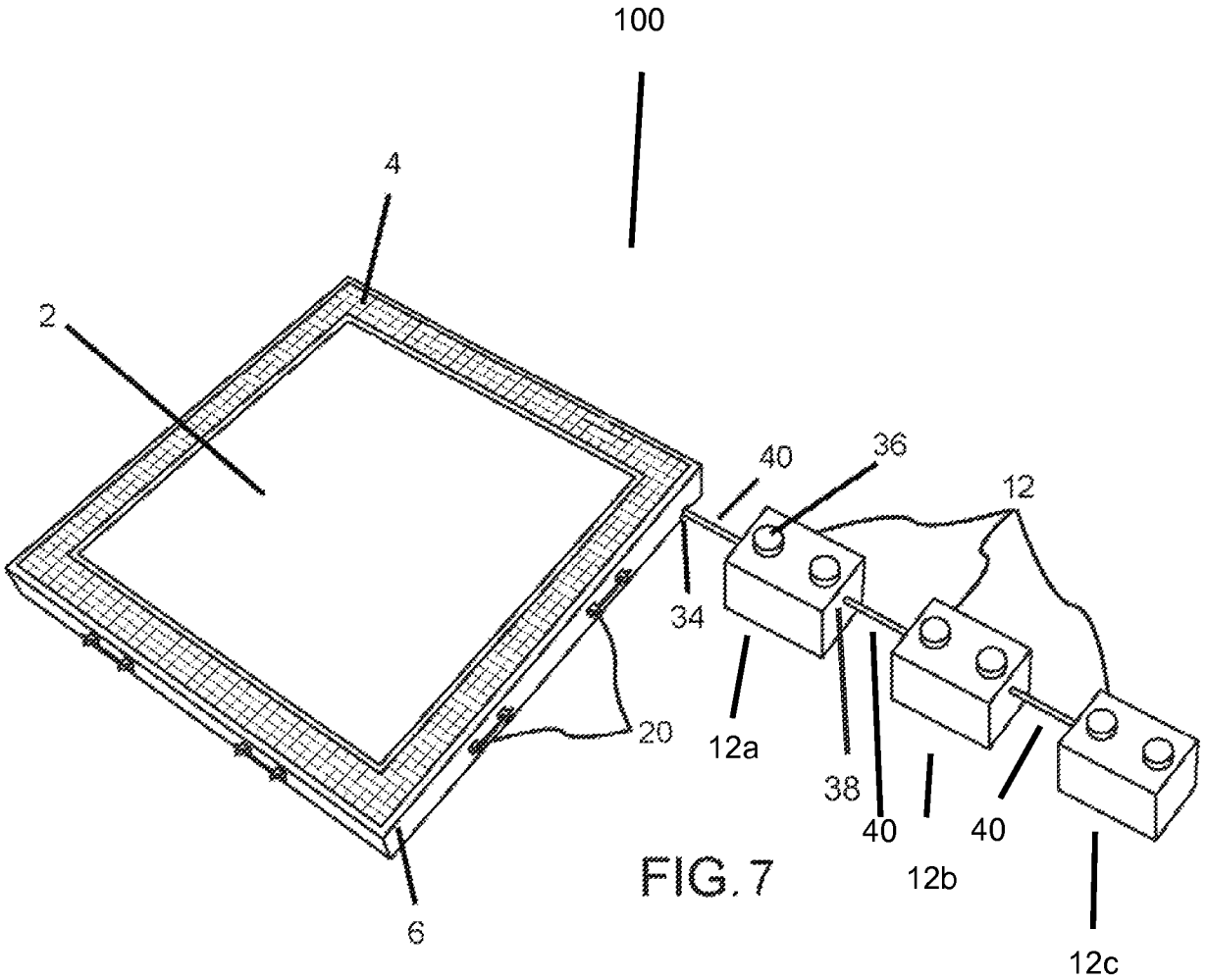

FIG. 1 is a perspective view of a liquid collection member according to one embodiment of the present invention;

FIG. 2 is a cross-sectional front elevation view of the foundation slab according to one embodiment of the present invention;

FIGS. 3A-3B is on cross-sectional front elevation views of the drain channels and liquid collection plates according to one embodiment of the present invention;

FIGS. 4A-4B are front elevation views depicting a plurality of interconnected liquid collection members according to embodiments of the present invention;

FIG. 5 is a cross-sectional front elevation view of a liquid collection system according to one embodiment of the present invention in an assembled state;

FIG. 6A-6B is a front elevation view of a liquid collection and storage chamber according to one embodiment of the present invention; and FIG. 7 is a perspective view of a liquid collection system including liquid storage and/or treatment features according to one embodiment of the present invention.

DETAILED DESCRIPTION OF THE INVENTION

The present invention has significant benefits across a broad spectrum of endeavors. It is the Applicant's intent that this specification and the claims appended hereto be accorded a breadth in keeping with the scope and spirit of the invention being disclosed despite what might appear to be limiting language imposed by the requirements of referring to the specific examples disclosed. To acquaint persons skilled in the pertinent arts most closely related to the present invention, a preferred embodiment of the method that illustrates the best mode now contemplated for putting the invention into practice is described herein by, and with reference to, the annexed drawings that form a part of the specification. The exemplary method is described in detail without attempting to describe all of the various forms and modifications in which the invention might be embodied. As such, the embodiments described herein are illustrative, and as will become apparent to those skilled in the arts, can be modified in numerous ways within the scope and spirit of the invention.

Referring now to FIGS. 1-7, a foundation slab liquid management and collection system 100 of one embodiment of the present invention is shown which generally comprises a foundation slab 2, a plurality of liquid collection plates 4, a plurality of drain channels 6, a plurality of channel connecting anchors 20, a plurality of slab connecting anchors 32, and at least one liquid collection and storage container 12.

FIG. 1 shows a perspective view of the drain channels 6 and liquid collection plates 4 fully assembled, forming the perimeter of the foundation slab liquid management and collection system 100. The perimeter of the collection system 100 comprises a plurality of drain channels 6 being placed in a rectangular shape and interconnected by channel connecting anchors 20 which further comprise a first angle bracket 22, a second angle bracket 24, and a threaded rod insert 26. The placement of the drain channels 6 to create the perimeter forms a cavity 42 which may optionally contain a plurality of slab reinforcing elements 30 which will act as anchors. The drain channels 6 are in fluid communication with one another and are covered by a plurality of liquid collection plates 4 which direct the flow of liquid into the drain channels 6 and may optionally comprise slab connecting anchors 32. The drain channels 6 will further allow for the flow of liquid from one drain channel 6 to another until the fluid reaches at least one circular void opening 34. These features will now be explained in greater detail.

FIG. 2, shows a cross-sectional view through the center of the foundation slab 2. The foundation slab 2 is rectangular in shape and comprises a body 28 and an outer perimeter 14. The body 28 of the foundation slab 2 may additionally comprise one or more slab reinforcing elements 30 which are anchored into the ground and extend into the body 28 of the foundation slab 2. The slab reinforcing elements 30 may comprise steel rebar which may be bent such that the slab reinforcing elements 30 extend first vertically into the body 28 of the foundation slab 2 before bending and further extending laterally throughout the body 28 of the slab 2. The slab reinforcing elements 30 may be arranged in groups throughout the body 28 of the slab 2, each group comprising a plurality of slab reinforcing elements 30. The foundation slab 2 may either be cast-in-place or be a pre-cast foundation slab 2.

FIGS. 3A-3B show a front view and back view of the drain channels 6, respectively. As can be seen, the drain channels 6 are rectangular in shape, having generally a planar top 44, bottom 46, front end surface 48, back end surface 50, and first and second side surfaces 52,54. The planar top 44 surface has a continuous, recessed void 16 disposed in the center of the drain channel 6 which runs along the entire length of the drain channel 6. The recessed void 16 is generally U-shaped, having a generally horizontal curved bottom surface 56 that connects to first 58 and second 60 generally vertical side surfaces which extend upward and connects to the generally planar top surface 44 in such a way as to create a recessed edge 18, such that the distance between the recessed edge 18 and the planar top surface 44 of the drain channel 6 is equal to or greater than the thickness of the liquid collection plates 4. In an alternative embodiment, the generally U-shaped curved bottom surface 56 may embody a slope, such that gravity facilitates the flow of liquid through the drain channel 6.

FIGS. 3A-3B also shows the liquid collection plates 4. The liquid collection plates 4 have a rectangular cross-section and, as can be seen in FIGS. 3A-3B, are placed on top of the generally planar top surface 44 of the drain channels 6 such that the liquid collection plates 4 rest on, and are removably connected to, the recessed edge 18 of the recessed void 16, forming a generally planar surface connection between the liquid collection plates 4 and the generally planar top surface 44 of the drain channels 6. In a preferred embodiment, the liquid collection plates 4 are grates having a plurality of open regions to allow for the flow of liquid through the grate and into the drain channel 6. However, the liquid collection plates 4 may be represented in a variety of embodiments, including but not limited to, grates, perforated metal, or concrete with slotted voids.

The drain channels 6 are segmented and in certain embodiments comprise straight, curved, or cornered segments. As can be seen in FIGS. 4A-4B, the drain channels 6 utilize a tongue and groove, or ship lap, connection joint and channel connecting anchors 20 for assembly. The front end surface 48 of the drain channel 6 comprises a tongue connection 62, which is inserted into the groove connection 64 on the back end surface 50 of the drain channel 6. Channel connecting anchors 20 are attached to first and second sides of the drain channels 6 and serve to tighten the connection made between the tongue and groove connection joints. The channel connecting anchors 20 are comprised of first angle bracket 22 and second angle bracket 24 fastened together with a threaded rod insert 26 or similar fasteners such as threaded bolts and nuts and/or other features as will be recognized by one of ordinary skill in the art. At least one of the drain channels 6 comprises a circular void opening 34 to allow for liquids to exit the drain channels 6.

To fasten two adjacent drain channels 6, two channel connecting anchors 20 are used. To install the first channel connecting anchor 20, the first angle bracket 22 is mounted to the first side of the drain channel 6 and the second angle 24 bracket is mounted to the first side of an adjoining drain channel 6 with both angle brackets receiving a threaded rod insert 26. To install the second channel connecting anchor 20, the first angle bracket 22 is mounted to the second side of the drain channel 6 and the second angle bracket 24 is mounted to the second side of an adjoining drain channel 6, with both angle brackets receiving a threaded rod insert 26. Once both channel connecting anchors 20 are in place, the threaded rod insert 26 is tightened, further sealing the tongue and groove connection. Once the connection between the tongue and groove is made and tightened by the channel connecting anchors 20, it may be further sealed utilizing a butyl or similar joint sealing material to create a water tight seal.

FIG. 5 shows a center cross-sectional view of the foundation slab 2 and the drain channels 6 according to one embodiment of the present invention. The drain channels 6 are disposed at, and interconnected with, the outer perimeter 14 of the foundation slab 2. The drain channels 6 interconnect with the outer perimeter 14 of the foundation slab 2 via slab connecting anchors 32. When the foundation slab 2 is cast in place, the slab connecting anchors 32 may comprise steel rebar embedded or inserted through the side of the drain channel 6 in contact with the outer perimeter 14 of the foundation slab 2. This allows for the drain channel 6 sides to serve as the form for the foundation slab 2. When the foundation slab 2 is pre-cast, the slab connecting anchors 32 may comprise any one or more of angle brackets, fastening hardware, or other mechanical connections that serve to connect the drain channels 6 to the outer perimeter 14 of the pre-cast foundation slab 2. When the drain channels 6 are being interconnected to an existing foundation slab 2, the slab connecting anchors 32 chosen will depend on the foundation slab 2 that the drain channels 6 are being interconnected to, as well as the given site conditions. The slab connecting anchors 32 used may include any of the previously discussed slab connecting anchors 32 including but not limited to steel rebar, angle brackets, fastening hardware, or other mechanical connections. The connection between the drain channels 6 and the foundation slab 2 may optionally be made permanent by drilling holes into the sides of the existing foundation slab 2 and attaching the drain channel 6 thereto by means of steel rebar and an adhesive which may be an epoxy, cementitous materials, or similar adhesives.

The liquid collection and storage chamber 12, as depicted in the embodiment of FIGS. 6A-6B, comprises at least one concrete vault having a generally planar slab top 66, a vault body 68 having a generally planar bottom 70 and side surfaces 72 having a thickness approximately equal to the thickness of the slab top 66. The slab top 66 comprises at least one access opening 36, whereby a user can access the chamber 12 interior. The storage chamber 12 additionally comprises an outlet opening 38, which is disposed such that it is lower than the foundation slab 2 and drain channel 6 components, such that liquids can gravitationally flow towards, and be collected by, the liquid collection and storage chamber 12. In certain embodiments, collected liquids within chambers 12 are treated within the chamber or conveyed to treatment-specific devices including, but not limited to oil/water separators, grease traps, desalinators, flocculators and the like. The liquid collection and storage chamber 12 may be embodied as, but is not limited to, vaults that store, treat, re-use, filter, or otherwise manage the liquid collection from the slab 2.

As can be seen in FIG. 7, a plurality of liquid collection and storage chambers 12 according to one embodiment of the invention is in fluid communication with the drain channels 6 via a transport pipe 40. The transport pipe 40 is generally circular in shape, have a first and second end and a circumference, wherein the circumference is less than or equal to the circumference of the circular void opening 34 and the outlet opening 38. A first end of the transport pipe 40 is inserted into the circular void opening 34 of the drain channel 6 and a second end of the transport pipe 40 is inserted into the outlet opening 38 of the storage chamber 12. In one embodiment, the foundation slab liquid management and collection system 100 comprises a plurality of liquid collection and storage chambers 12*a*, 12*b*, 12*c* receiving liquid from the drain channels 6. In this embodiment, the first storage chamber 12*a* will comprise at least two outlet openings 38. The first outlet opening 38 will receive the transport pipe 40 connected to the circular void opening 34, while the second outlet opening 38 will receive a second transport pipe 40 which will be inserted into the first outlet opening 38 of a second storage chamber 12*b*. In an alternative embodiment, one or more collection and storage chambers 12 receive liquid from a plurality of circular void openings 34 provided in the system. In one embodiment, each of the plurality of storage chambers comprises a different treatment device.

It is to be understood that the drain channels 6 may be manufactured in a variety of configurations within the scope and intent of the invention disclosed herein. The present invention may also be fabricated to embody or receive a variety of liquid collection plates including grates, perforated metals, perforated concrete, as well as other liquid permeable materials not specifically referred to herein.

The drain channels are contemplated as being manufactured from precast concrete, however other materials may be used including but not limited to, plastic, polymer concrete, or similar materials which may be represented in a variety of types and composition mixes having various combinations of ingredients such as those found in the manufacture of concrete, plastics, polymers, cement, water, cementitious materials, and chemical and or mineral admixtures, coloring agents, which when combined will create the concrete material used to manufacture features of the invention. The invention may also embody a wide variety of different finishes, colors, and textures such as those commonly utilized in the architectural and stone industries.

The foundation slab liquid collection and management system is intended for use to capture or collect liquids such as oils, fuels, lubricants, hazardous waste, fire extinguishing chemicals, foams, water, rain or storm water, and other liquids that may be dumped onto, spill from, or leak from equipment such as electrical transformers, electrical cooling systems, air conditioning compressors, air conditioning condensers, or other similar equipment commonly found on a foundation slab.

While various embodiments of the present invention have been described in detail, it is apparent that modifications and alterations of those embodiments will occur to those skilled in the art. However, it is to be expressly understood that such modifications and alterations are within the scope and spirit of the present invention. Further, the invention(s) described herein are capable of other embodiments and of being practiced or of being carried out in various ways. In addition, it is to be understood that the phraseology and terminology used herein is for the purposes of description and should not be regarded as limiting. The use of "including," "comprising," or "adding" and variations thereof herein are meant to encompass the items listed thereafter and equivalents thereof, as well as, additional items.

What is claimed is:

1. A liquid drainage and collection system for a foundation slab, the system comprising:

a plurality of liquid collection segments, each of said plurality of liquid collection segments comprising an internal trough for directing liquid to a point of lower gravitational potential energy;

at least two of the plurality of liquid collection segments interconnected by connecting anchors;

a plurality of liquid collection plates covering the internal troughs of the liquid collection segments;

said plurality of liquid collection segments comprising at least one planar surface adapted to be positioned adjacent a substantially vertical sidewall of a foundation slab, and wherein the at least one planar surface comprises inwardly extending slab connecting anchors operable to connect the system to a foundation slab;

said plurality of liquid collection segments comprising a drain outlet and a slope for directing liquid to said drain outlet;

at least one of a fluid storage container and a fluid treatment container; and wherein said drain outlet is in fluid communication with the at least one of a fluid storage container and a fluid treatment container via a conduit.

2. The liquid drainage and collection system of claim 1, wherein the plurality of liquid collection plates comprises at least one grate to allow for ingress of liquid.

3. The liquid drainage and collection system of claim 1, wherein at least one of said plurality of liquid collection segments comprises a right-angled segment for substantially conforming to a corner of a foundation slab.

4. The liquid drainage and collection system of claim 1, wherein each of said plurality of liquid collection segments comprise precast concrete segments.

5. The liquid drainage and collection system of claim 1, wherein said internal trough extends along the entirety of a length of a respective liquid collection segment.

6. The liquid drainage and collection system of claim 1, wherein said trough comprises a U-shaped trough.

7. The liquid drainage and collection system of claim 1, wherein said channel comprises at least one of U-shaped trough and a V-shaped trough.

8. The liquid drainage and collection system of claim 1, wherein the connecting anchor comprises at least one bracket and a threaded rod.

9. A liquid drainage and collection system for a foundation slab, the system comprising:

a plurality of liquid collection segments, each of said plurality of liquid collection segments comprising opposed and substantially parallel side panels, a bottom panel provided substantially perpendicular to said side panels, and an at least partially open upper section to allow for an ingress of liquid into an interior volume of said segment;

wherein at least one of the side panels comprises an inwardly extending slab connecting anchor operable to connect the system to a foundation slab;

said interior volume of said collection segments comprising a longitudinally extending channel for receiving and conveying liquid;

at least one of said side panels comprising an anchor member for interconnecting a first liquid collection segment to a second liquid collection segment, wherein the anchor member comprises at least one bracket and a threaded rod; and said plurality of liquid collection segments comprising a drain outlet and at least one slope for directing a liquid to said drain outlet.

10. The liquid draining and collection system of claim 9, wherein said upper section comprises a grate for allowing liquid ingress into said interior volume of said segment.

11. The liquid draining and collection system of claim 9, wherein said drain outlet is in fluid communication with at least one of a fluid storage container and a fluid treatment container.

12. The liquid draining and collection system of claim 9, wherein at least one of said plurality of liquid collection segments comprises a right-angled segment for substantially conforming to a corner of a foundation slab.

13. The liquid drainage and collection system of claim 9, wherein each of said plurality of liquid collection segments comprise precast concrete segments.

14. The liquid drainage and collection system of claim 9, wherein said channel extends along the entire length of a plurality of liquid collection segments.

15. A method of forming a liquid drainage and collection system for a slab foundation, the method comprising the steps of:

providing a plurality of liquid collection segments in a rectangular arrangement, each of said plurality of liquid collection segments comprising a substantially vertical surface, wherein at least one of the plurality of liquid collection segments comprises a connecting anchor extending from a substantially vertical surface;

wherein said plurality of liquid collection segments are in fluid communication with each other, and wherein at least one of said liquid collection segments comprises an outlet;

providing each of said plurality of liquid collection segments with a desired slope for conveying liquid to at least one adjacent liquid collection segment under the force of gravity;

providing a cast-in-place foundation slab within the plurality of liquid collection segments, and wherein the connecting anchor extends into the foundation slab;

providing a conduit and at least one of a liquid storage container and a liquid treatment container wherein said outlet, said conduit and said at least one of a liquid storage container and a liquid treatment container are in fluid communication with each other.

16. The method of claim 15, wherein at least one of said liquid collection segments comprises an internal channel adapted to concentrate liquid in a point of reduced gravitational potential energy with respect to said slab foundation.

17. The method of claim 15, wherein at least one of said liquid collection segments comprises an opening in an upper portion to allow for ingress of liquid into said liquid collection segment.

18. The method of claim 17, wherein said upper portion comprises a grate to allow for ingress of liquid while preventing ingress of debris.

19. The method of claim 15, wherein at least one of said plurality of liquid collection segments comprises a right-angled segment adapted to conform to a right-angled corner of said slab foundation.

20. The method of claim 15, wherein at least one of said plurality of liquid collection segments comprises a rectilinear cross-section with an open upper portion and an interior volume comprising a channel.

* * * * *